United States Patent [19]

Knapp, Jr.

[11] 4,204,182

[45] May 20, 1980

[54] INDICATING OR STRIKER PIN FOR ELECTRIC FUSES

[75] Inventor: Edward J. Knapp, Jr., Merrimac, Mass.

[73] Assignee: Gould Inc., Ill.

[21] Appl. No.: 901,471

[22] Filed: May 1, 1978

[51] Int. Cl.[2] ..... H01H 85/30
[52] U.S. Cl. ..... 337/244; 337/267
[58] Field of Search ..... 337/241, 244, 267, 77

[56] References Cited

U.S. PATENT DOCUMENTS

| | | | |
|---|---|---|---|
| 3,183,327 | 5/1965 | Kozacka | 337/244 X |
| 3,391,369 | 7/1968 | Kozacka | 337/244 X |
| 4,023,133 | 5/1977 | Knapp | 337/244 X |

*Primary Examiner*—Harold Broome
*Attorney, Agent, or Firm*—Erwin Salzer

[57] ABSTRACT

The current path of an electric indicating or striker pin fuse, and more particularly its fusible element, includes a point of maximum resistance where fusion of the latter must take place. That predetermined point is arranged in such a way that the pulverulent arc-quenching filler does not impair the proper operation of the indicating or striker pin device.

5 Claims, 3 Drawing Figures

INDICATING OR STRIKER PIN FOR ELECTRIC FUSES

BACKGROUND OF THE INVENTION

Indicating pin fuses include a biased pin that moves in a direction longitudinally thereof in response to blowing of a fuse to indicate that the fuse has blown. Striker pin fuses include also a pin that moves in response to blowing of a fuse, but the object of a striker pin is to perform some mechanical work in response to blowing of a fuse, e.g. to unlatch the latch mechanism of a circuit breaker. Both indicating and striker pin fuses may have identical design features, except that striker pin fuses must generally have a stronger biasing force, e.g. a stronger spring, since their striker pin is supposed to perform work, while an indicating pin is not supposed to perform work.

Indicating and striker pin fuses include an elongated means, such as a pin, that is responsive to blowing of the fuse. Normally the indicating or striker pin is restrained, or held captive, by the restraining wire or fusible element of the fuse. The fusible element is normally embedded in a pulverulent arc-quenching filler and the point where initial fusion of the fusible element occurs is normally unknown, i.e. its location is unpredictable. As long as the fusible element is straight, or V-shaped, the fact is of no consequence that the point of initial break formation is unknown because under such conditions the force biasing the indicating or striker pin is sufficiently high to move an interrupted fusible element inside of a body of pulverulent arc-quenching filler. This is no longer possible where the fusible element exerts a high resistance against the drawing force, i.e. the force tending to displace it, e.g. where the fusible element is wound helically. It is, therefore, the principal object of the present invention to provide electric indicating and striker pin fuses that operate properly though their fusible element is precluded, e.g. by friction, from sliding inside the pulverulent arc-quenching filler. Another object of the invention is to adapt conventional indicating and striker pin fuses, such as disclosed, for instance, in U.S. Pat. No. 3,697,916; 10/10/72 to Richard A. Belcher et al for ELECTRIC LOW-VOLTAGE FUSE for application in fuses whose fusible element that controls the operation of the indicating or striker pin is wound helically, or precluded for other reasons from moving inside the pulverulent arc-quenching filler into which it is embedded.

The closest prior art known to me dealing with similar problems are U.S. Pat. No. 3,832,665; 08/27/74 to Richard A. Belcher for BLOWN FUSE INDICATOR FOR HIGH-VOLTAGE FUSES, and U.S. Pat. No. 4,001,749; 01/04/77 to Frederick J. Kozacka for ELECTRIC FUSE FOR ELEVATED CIRCUIT VOLTAGES.

SUMMARY OF THE INVENTION

Fuses according to the present invention include a first fuse terminal and electrically conductive elongated means responsive to blowing of a fuse movable in a direction longitudinally thereof. Said elongated means is in conductive relation with said first terminal. Said electrically conductive elongated means is biased by spring means in a direction longitudinally thereof. A partition of electric insulating material extends transversely to said elongated means and has an aperture for the passage of said elongated means, and said elongated means project through said passage. A second fuse terminal is arranged in spaced relation from said first fuse terminal. A fusible element is conductively connected with one end thereof to said second terminal and engages with the other end thereof said portion of said elongated means projecting through said passage. The point of engagement of said fusible element and said elongated means is the point of highest resistance of said fusible element so that fusion of said fusible element will occur at said point.

DESCRIPTION OF PREFERRED EMBODIMENTS

Figure 1:
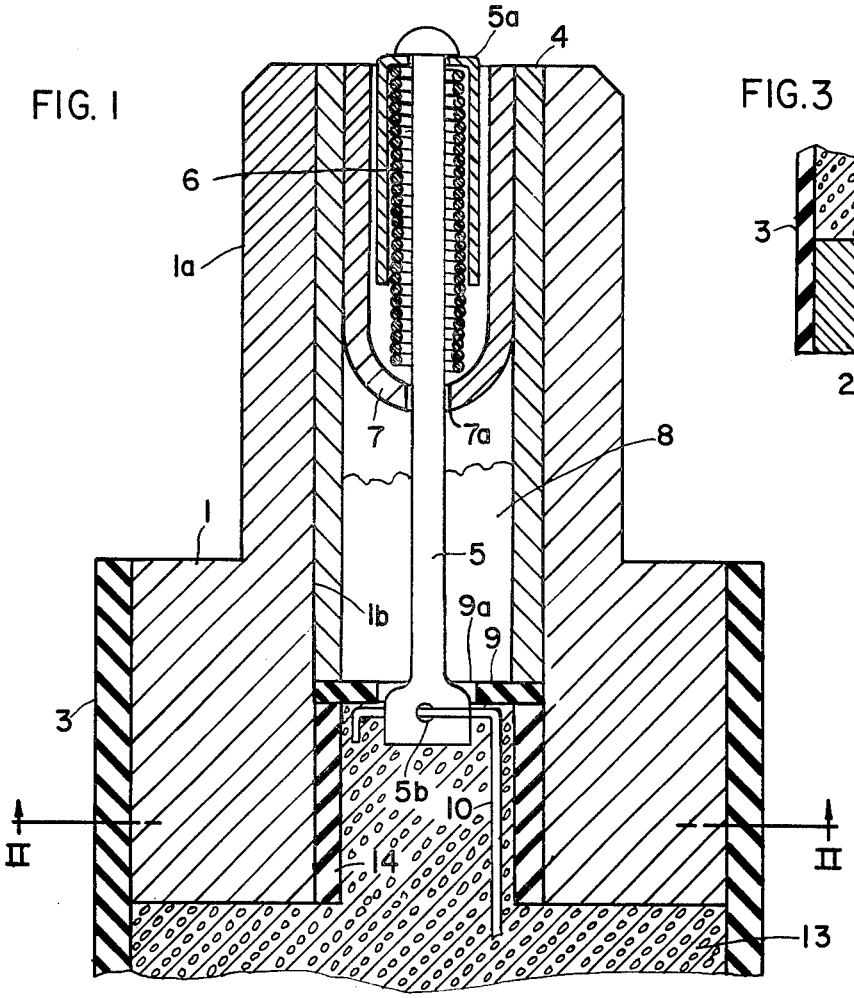
FIG. 1 is a vertical section of a fuse embodying the present invention taken along I—I of FIG. 2 and showing the part of an indicating or striker pin adjacent one of the terminals of an electric fuse.

Indicator or striker pin devices are being manufactured in two types. In one type the indicator or striker pin device is in itself a complete structure which is shunted across a fuse to indicate whether or not the fuse has blown. In the other type the indicator or striker pin device forms an integral part of a fuse structure whose state it is supposed to indicate. The drawing illustrates an indicator or striker pin device of the first mentioned type.

Figure 3:
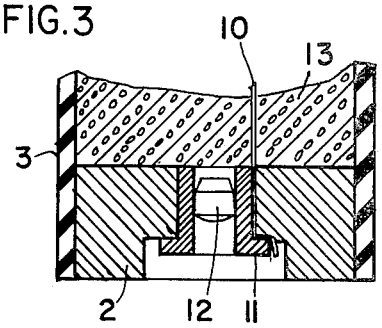
FIG. 3 shows on a smaller scale than FIG. 1 the end of the indicating or striker pin mechanism adjacent the opposite terminal of the fuse.
Figure 2:
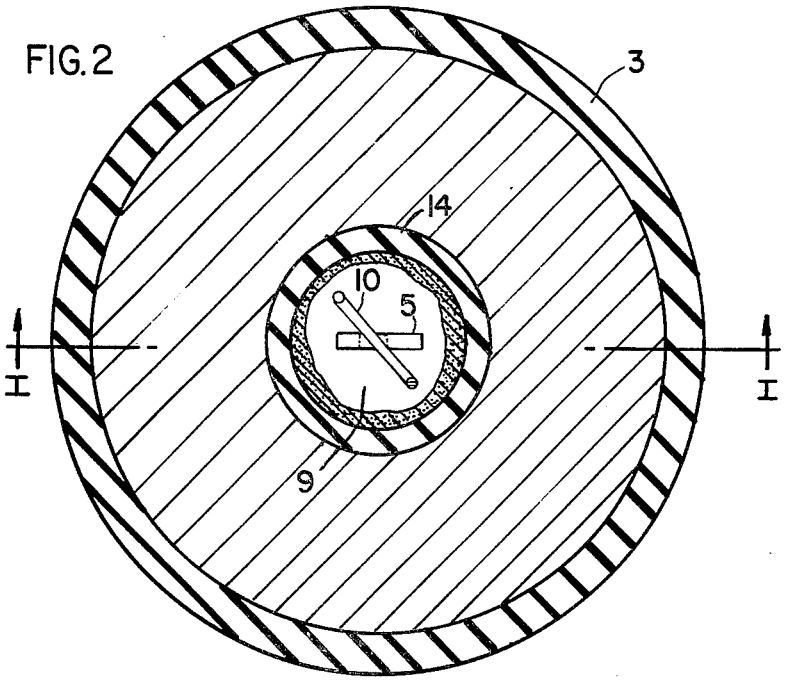
FIG. 2 is a section along II—II of FIG. 1.

The structure shown in the drawing, and more particularly FIGS. 1 and 3, includes two plug type terminal elements 1,2 of which each plugs one of the ends of a casing 3 of electric insulating material. Casing 3 and terminal plugs 1,2 are tied together by fastener means, as for instance, roll pins, not shown in the drawing. Terminal element 1 is provided with a coaxial projection **1*a* forming an integral part of terminal element 1. Arranged inside a bore 1*b* inside part 1,1*a* and extending throughout its length is a metal tube 4 press-fitted into part 1*a*. The length of tube 4 slightly exceeds that of part 1*a*. Inside of tube 4 arranged in coaxial relation thereto is an electroconductive elongated means or rod 5 responsive to blowing of a fuse and movable in a direction longitudinally thereof. The upper end of elongated indicating or operating means 5 holds in position a cap 5*a* against which the upper end of helical spring 6 rests. Interposed between tube or tubular member 4, on the one hand, and cap 5*a* and spring 6, on the other hand, is a member 7 in part cylindrical and in part spherical that has a hole 7*a* at the apex of its spherical portion. Rod or indicating or striking member 5 extends through hole 7*a* into chamber 8 formed by tube 4 and closed on its lower end by a partition 9 of electric insulating material. Partition 9 is provided with an aperture 9*a* through which elongated part 5 projects. The lower end of elongated part 5 is flattened, projects through aperture 9*a* and is provided with a hole or opening 5*b*. The upper end of wire 10 is threaded through hole or opening 5*b* and bent to form a hook. This serves the dual purpose of maintaining the fusible element 10 in electrical contact with elongated pin means 5 and establishing the point of highest resistance of the current-path extending from terminal element 1 to terminal element 2. The lower end of wire 10 is anchored in terminal 2 by an anchor member 11 that is tubular and plugged by a plug member 12. Plug member 12 and anchor member 11 allow filling of fuse casing 3 with a pulverulent arc-quenching filler 13, e.g. quartz sand. Arc-quenching filler 13 must be prevented from entering into chamber 8 by way of aperture 9***a*. To this end chamber 8 is filled with a pasty substance. Silicone grease is particularly suitable for filling chamber 8 because relatively high temperatures may be encountered in electrical equipment of the kind under consideration. The pasty substance must preclude filler 13 from entering into chamber 8 but must allow movement of elongated member 5 therein in a direction longitudinally thereof.

The bore 1*b* below partition 9 is provided with a tubular sleeve 14 of electric insulating material that prevents shunting out of any portion of fusible element or wire 10 by engagement with the wall of bore 1*b* of terminal 1.

The current path in the device which has been described above is as follows: terminal 1; tubular metal member 4; part 7; spring 6; cap 5*a;* elongated member 5; opening 5*b;* wire 10, and terminal 2. For reasons of clarity the point of engagement of helical spring 6 and member 7 has not been shown. Since spring 6 expands, its lower end must necessarily engage part 7 and thus close the current path from terminal 1 to terminal 2. The point of engagement of fusible element or wire 10 and the portion of part 5 projecting through passage 9*a* of partition 9 is the point of highest resistance of fusible element 10. That point is the point at which wire 10 is threaded through hole 5*b*. Consequently fusion of element 10 will take place at this specific point of the current path through the fuse.

I claim as my invention:

1. A solderless indicating and striker pin device to be shunted across electric fuses comprising (a) a first fuse terminal (1);

(b) electroconductive pin means (5) conductively connected to said first fuse terminal (1) and spring (6) biased in a direction longitudinally thereof;

(c) a partition (9) of electric insulating material extending transversely to said pin means (5) and defining a passageway for the passage of said pin means (5) from a first space to one side to a second space to the other side of said partition (9);

(d) a second fuse terminal (2) arranged in spaced relation from said first fuse terminal (1);

(e) a fusible element (10) conductively connected with one end thereof to said second terminal (2) and engaging with the other and thereof said pin means (5) on said other side of said partition (9); and (f) the point of engagement of said fusible element (10) and said pin means (5) being the point of highest resistance of the current path extending between said first terminal (1) and said second terminal (2) so that a break of said fusible element (10) will be initiated at said point by the highest generation of heat at said point.

2. A solderless indicating and striker pin device as specified in claim 1 wherein said fusible element is wound helically and embedded in a mass of arc-quenching filler (13) obstructing by friction operation of said device if the point of fusion is situated anywhere in said arc-quenching filler (13), and wherein proper operation of said indicating and striker pin device is assured by the fact that the point of engagement of said fusible element (10) and said pin means (5) is the point of highest resistance in the current-path extending between said first terminal (1) and said second terminal (2).

3. A solderless indicating and striker pin device as specified in claim 1 wherein the end of said pin means (5) in said second space is flattened and provided with a hole (5*b*) through which said fusible element (10) is threaded and wherein the point of highest resistance of the current path extending between said first terminal (1) and said second terminal (2) is the interface between said hole (5*a*) and said fusible element (10).

4. A solderless indicating and striker pin device as claimed in claim 1 wherein said first terminal (1) is provided with a bore (1*b*), a first tubular member (4) of metal being inserted into said bore (1*b*), said pin means (5) and said spring (6) being inserted into said tubular member and closed on one end thereof by said partition (9), wherein a second tubular member (14) of electric insulating material is arranged in coaxial relation to said first mentioned tubular member (4) and in abutting relation to said partition (9), said second tubular member (14) housing the point of engagement of said fusible element (10) and said pin means (5), and wherein said first mentioned tubular member (4) is filled with a pasty substance (8) at the end thereof adjacent said partition.

5. A solderless indicating and striker pin device as specified in claim 3 wherein said pasty substance is silicone grease (8).

* * * * *